US008290632B2

(12) United States Patent
Briers et al.

(10) Patent No.: US 8,290,632 B2
(45) Date of Patent: Oct. 16, 2012

(54) METHOD FOR CONTROLLING PRODUCTION AND DOWNHOLE PRESSURES OF A WELL WITH MULTIPLE SUBSURFACE ZONES AND/OR BRANCHES

(75) Inventors: Jan Jozef Maria Briers, Rijswijk (NL); Keat-Choon Goh, Rijswijk (NL); Christophe Lauwerys, Leuven (BE); Peter Stefaan Lutgard Van Overschee, Leuven (BE); Henk Nico Jan Poulisse, Rijswijk (NL)

(73) Assignee: Shell Oil Company, Houston, TX (US)

( * ) Notice: Subject to any disclaimer, the term of this patent is extended or adjusted under 35 U.S.C. 154(b) by 349 days.

(21) Appl. No.: 12/705,861

(22) Filed: Feb. 15, 2010

(65) Prior Publication Data

US 2010/0217575 A1 Aug. 26, 2010

(51) Int. Cl.
*G05D 11/00* (2006.01)
*G05D 11/02* (2006.01)

(52) U.S. Cl. ..... 700/282; 700/285; 703/10; 702/45; 702/46; 702/47; 702/48; 702/49; 166/266; 166/386; 166/316; 166/320; 166/344; 166/271; 166/91.1

(58) Field of Classification Search ..... 700/282, 700/285; 166/266, 386, 316, 320, 344, 271, 166/91.1; 703/10
See application file for complete search history.

(56) References Cited

U.S. PATENT DOCUMENTS

| | | | | |
|---|---|---|---|---|
| 6,112,817 | A | 9/2000 | Voll et al. | 166/370 |
| 6,330,913 | B1 | 12/2001 | Langseth et al. | 166/250.01 |
| 6,367,566 | B1 * | 4/2002 | Hill | 166/370 |
| 6,478,091 | B1 * | 11/2002 | Gano | 166/373 |
| 6,508,312 | B1 * | 1/2003 | Latiolais et al. | 166/386 |
| 6,561,041 | B1 | 5/2003 | Eck | 73/861.04 |
| 6,857,475 | B2 * | 2/2005 | Johnson | 166/278 |
| 6,920,395 | B2 * | 7/2005 | Brown | 702/13 |
| 6,937,923 | B1 * | 8/2005 | Bassett | 700/282 |
| 7,073,594 | B2 * | 7/2006 | Stegemeier et al. | 166/369 |
| 7,147,059 | B2 * | 12/2006 | Hirsch et al. | 166/372 |
| 7,218,997 | B2 * | 5/2007 | Bassett | 700/286 |
| 7,303,010 | B2 * | 12/2007 | de Guzman et al. | 166/255.1 |
| 7,419,002 | B2 * | 9/2008 | Dybevik et al. | 166/205 |
| 7,430,153 | B2 * | 9/2008 | Fraser et al. | 166/386 |
| 7,455,114 | B2 * | 11/2008 | MacDougall | 166/373 |
| 7,558,699 | B2 * | 7/2009 | Beck et al. | 702/182 |
| 7,559,375 | B2 * | 7/2009 | Dybevik et al. | 166/316 |
| 7,620,481 | B2 * | 11/2009 | Dykstra | 700/285 |
| 7,640,975 | B2 * | 1/2010 | Cavender et al. | 166/207 |

(Continued)

FOREIGN PATENT DOCUMENTS

| | | |
|---|---|---|
| EP | 1004747 | 5/2000 |

(Continued)

*Primary Examiner* — Mohammad Ali
*Assistant Examiner* — Kelvin Booker

(57) ABSTRACT

A method for controlling the influx of fluids into a multizone well in which each inflow zone is provided with an inflow control device, comprises: assessing the flux of oil, gas, water and other effluents from the well; monitoring production variables, including ICD position and/or fluid pressure in each inflow zone upstream of each ICD and/or downstream of each ICD; sequentially adjusting the position of each of the ICDs and assessing the flux of crude oil, natural gas and/or other well effluents; monitoring production variables; deriving a zonal production estimation model for each inflow zone of the well; and adjusting each ICD to control the influx of crude oil, natural gas and/or other effluents into each inflow zone on the basis of data derived from the zonal production estimation model for each inflow zone of the well.

14 Claims, 6 Drawing Sheets

U.S. PATENT DOCUMENTS

| | | | | |
|---|---|---|---|---|
| 7,660,648 | B2 * | 2/2010 | Dykstra | 700/285 |
| 7,668,694 | B2 * | 2/2010 | Anderson et al. | 700/281 |
| 7,711,486 | B2 * | 5/2010 | Thigpen et al. | 702/9 |
| 7,832,473 | B2 * | 11/2010 | Pensgaard | 166/193 |
| RE41,979 | E * | 12/2010 | Latiolais et al. | 166/386 |
| 7,869,978 | B2 * | 1/2011 | Anderson et al. | 702/182 |
| 7,971,637 | B2 * | 7/2011 | Duhon et al. | 166/54.5 |
| 7,984,760 | B2 * | 7/2011 | Haeberle et al. | 166/278 |
| 7,992,633 | B2 * | 8/2011 | Donald et al. | 166/75.12 |
| 7,992,643 | B2 * | 8/2011 | Donald et al. | 166/339 |
| 8,037,940 | B2 * | 10/2011 | Patel et al. | 166/386 |
| 8,066,067 | B2 * | 11/2011 | Donald et al. | 166/267 |
| 8,091,630 | B2 * | 1/2012 | Donald et al. | 166/90.1 |
| 8,122,948 | B2 * | 2/2012 | Donald et al. | 166/75.12 |
| 8,131,470 | B2 * | 3/2012 | Yusti et al. | 702/12 |
| 8,180,593 | B2 * | 5/2012 | Anderson et al. | 702/182 |
| 2002/0049575 | A1 * | 4/2002 | Jalali et al. | 703/10 |
| 2005/0263287 | A1 | 12/2005 | Chee, Jr. et al. | 166/313 |
| 2006/0052903 | A1 * | 3/2006 | Bassett | 700/282 |
| 2006/0076150 | A1 * | 4/2006 | Coronado et al. | 166/386 |
| 2006/0162935 | A1 * | 7/2006 | MacDougall | 166/375 |
| 2007/0114044 | A1 * | 5/2007 | Brezinski et al. | 166/386 |
| 2008/0165613 | A1 * | 7/2008 | Dykstra | 700/285 |
| 2008/0308274 | A1 * | 12/2008 | MacDougall | 166/278 |
| 2008/0314590 | A1 * | 12/2008 | Patel | 166/278 |
| 2009/0032267 | A1 * | 2/2009 | Cavender et al. | 166/386 |
| 2009/0205819 | A1 * | 8/2009 | Dale et al. | 166/250.01 |
| 2009/0216508 | A1 * | 8/2009 | Dale et al. | 703/10 |
| 2010/0206546 | A1 * | 8/2010 | Donald et al. | 166/91.1 |
| 2010/0206547 | A1 * | 8/2010 | Donald et al. | 166/91.1 |
| 2010/0206576 | A1 * | 8/2010 | Donald et al. | 166/368 |
| 2010/0299111 | A1 * | 11/2010 | Dale et al. | 703/2 |
| 2011/0226483 | A1 * | 9/2011 | Donald et al. | 166/344 |
| 2011/0253380 | A1 * | 10/2011 | Donald et al. | 166/344 |
| 2012/0195770 | A1 * | 8/2012 | Anderson et al. | 702/47 |

FOREIGN PATENT DOCUMENTS

| | | |
|---|---|---|
| GB | 2191804 | 12/1987 |
| GB | 2376488 | 12/2002 |
| WO | WO9208875 | 5/1992 |
| WO | WO0229195 | 4/2002 |
| WO | WO0229196 | 4/2002 |
| WO | WO03095794 | 11/2003 |
| WO | WO2006048418 | 5/2006 |
| WO | WO2007/116006 | 10/2007 |
| WO | WO2007/116008 | 10/2007 |

* cited by examiner

Production from a Cluster of Wells to a Production Separator

Routing of a Single Well to a Test Separator

Production from a Multizone Well

Production from Multiple Zones with Concentric Tubing in a Multizone Well

Data Flow for Multizonal Well Surveillanvce

Zonal Pressure & Production Management

METHOD FOR CONTROLLING PRODUCTION AND DOWNHOLE PRESSURES OF A WELL WITH MULTIPLE SUBSURFACE ZONES AND/OR BRANCHES

RELATED APPLICATIONS

The present application claims priority from PCT/EP2008/060750, filed 15 Aug. 2008, which claims priority from European Patent Application 07114565.0 filed 17 Aug. 2007.

TECHNICAL FIELD OF THE INVENTION

The invention relates to a method for the adjustment and control of the production and downhole pressures of a hydrocarbon production well comprising two or more subsurface branches or zones from which well effluents are produced.

BACKGROUND OF THE INVENTION

Wells with extended (and possibly multiple) reservoir contact or "reach" are becoming more commonly deployed for more efficient production of oil and gas from fragmented reservoirs. Extended reach wells are typically segmented into multiple zones or branches (or laterals). Typically, fluid streams produced by individual branches or zones of a well are commingled into multiphase streams sub-surface within the well. In the current state of the art, the individual subsurface zones and branches are equipped with downhole pressure gauges, zonal isolation packers and inflow control devices, which allow the control of fluids from the different parts of the reservoir or different reservoirs into the individual zones or branches. The well fluids then flow to the surface where they are routed to one or more production manifold (header) conduits and further commingled with production from other wells. The commingled fluids are then routed via a fluid separation assembly (comprising one or more bulk separators and/or production separators) into fluid outlet conduits for transportation and sales of at least nominally separated streams of oil, water, gas and/or other fluids.

The concept of equipping extended reach wells with downhole pressure gauges, zonal isolation packers and inflow control devices, and other additional downhole sensing and control equipment, which will be referred to as "Smart Wells" below, has been discussed in a large number of patents and other publications, for example International Patent WO 92/08875 (Framo Developments (UK) Ltd. assignee) dated 1992, and U.S. Pat. No. 6,112,817 (Baker Hughes Inc. assignee) dated 2000, and the SPE Papers SPE103222 (McCraken et al), SPE90149 (Brouwer et al), SPE100880 (Obendrauf et al), SPE79031 (Yeten et al.), SPE102743 (Sun et al.), and so on, all of which were published in 2006 or earlier.

Some of the above publications deal mainly with the hardware and a extensive and extensive set of completion equipment, for example International Patent application WO 92/08875, which includes downhole completion sensors for logging and reporting not just pressures and temperatures but also flowrates and compositions. It is the current state of the art that downhole devices which even approximately report flowrates and compositions are widely regarded to be complex, impractical, unreliable and very likely to fail prematurely under the subsurface conditions. Specifically, the practical operational challenge of managing the production of the wells using downhole pressure and temperature production data only are not addressed in the WO 92/08875 prior art reference.

Other publications focus on the methods for operating a Smart Well to obtain maximum benefit, for example U.S. Pat. No. 6,112,817 and the SPE papers cited. All of these make broad assumptions on the operability of the wells, in particular that production rates and phases from each zone are available. This assumption is not practical and the operational challenge of tracking the production of the wells using downhole pressure and temperature production data only is not addressed. For example, U.S. Pat. No. 6,112,817 assumes that the flowrates and phases (oil, water, gas) from each of the zones is known or can be calculated from the sensors and other devices located downhole (Column 4, line 27, 67, Column 5, lines 1, 43 Column 6, line 26). U.S. Pat. No. 6,112,817 also assumes some mechanism for updating the underlying reservoir models (Column 2, line 49, Column 5, line 2) as a pre-requisite for computing the required control strategy. However, no specific downhole multiphase flow measurement device or algorithm is suggested for the practical computation of the flows and phases from the individual zones or for updating the pertinent part of the reservoir model.

A problem associated with management of fluid flow at the outlet of a "Smart Well" comprising two or more branches or zones from which well effluents are produced is that this fluid flow stems from the commingled flux from two or more of the zones or branches of the well and does not provide information about the composition and flux of fluids produced via the individual zones or branches. Consequently, in conventional operation, the individual flux of fluids produced by the individual zones or branches cannot accurately be allocated to the zones or branches or be tracked or be controlled in real time or over a period of time. Further, due to the pressure and flow interactions between the individual zones or branches, it is difficult to control the pressures or the production at the branches and zones even with inflow control devices, particularly as the devices allow only a limited range of positions and transitions between positions. The inability to track the individual zone or branch productions or to control the zone or branch pressures, together with the variability and uncertainty of the reservoir and zone or branch production properties over time, leads immediately to difficulties in managing the extended reach wells to optimize the effluent production of the wells or the ultimate recovery of effluents from the reservoir or reservoirs which the extended reach well drains. As an example, over-production of fluids in one zone or branch of a well may result in under-production from other zones or even cross-flow from strong zones to weak zones, and reduce the ultimate total oil recovered in the well.

In the present state of the art, subsurface multiphase flow measurement devices are often too expensive, have too restricted an operating envelop and are too complex to install in individual well subsurface zones or branches to allow individual oil, water and gas components of the individual well subsurface zones or branches to be measured continuously and reli-ably in real time, particularly as the multiphase flow characteristics and properties change significantly over the life of the well.

SPE paper 102743 addresses the critical requirement to estimate downhole production from each zone by proposing computational algorithms based on formulae on thermodynamic, fluid mechanic laws or pre-computed correlations. Such approach based on rigorous physical and flow models requires many significant characterizations, measurements and parameters not practically or economically available over the production life of an extended reach well, in oil and gas production environment. Additionally, such application also requires manual ad hoc tuning adjustments from time to time to relate the resulting models to observed reality.

Applicant's International patent application PCT/EP2005/055680, filed on 1 Nov. 2005, "Method and system for determining the contributions of individual wells to the production of a cluster of wells" discloses a method and system named and hereafter referred to as "Production Universe Real Time Monitoring" (PU RTM). The PU RTM method and apparatus allows accurate real time estimation of the contributions of individual wells to the total commingled production of a cluster of crude oil, gas and/or other fluid production wells, based on real time well measurement data such as well pressures, in combination with well models derived from data from a shared well testing facility for the individual testing of wells, and dynamically reconciled regularly with the total commingled production data.

Applicant's International patent application PCT/EP2007/053345, filed on 5 Apr. 2007, "Method for determining the contributions of individual wells and/or well segments to the production of a cluster of wells" discloses a method and system named and hereafter referred to as "PU RTM DDPT". The PU RTM DDPT, used in association with the method of PU RTM, allows the accurate real time estimation of the contributions of individual wells or well zones to the total commingled production of a cluster of crude oil, gas and/or other fluid production wells, based real time well data, in combination with well or zone models based on data derived solely from the metering of commingled production flows. The PU RTM DDPT method is specifically applicable and necessary for application of PU RTM data driven methods in oil and gas production facilities without a shared well testing facility for the individual testing of wells.

Applicant's International patent application PCT/EP2007/053348, filed on 5 Apr. 2007, "METHOD AND SYSTEM FOR OPTIMISING THE PRODUCTION OF A CLUSTER OF WELLS" discloses a method and system named and hereafter referred to as "PU RTO". The PU RTO, used in association with the method of PU RTM, provides a method and system to optimise the day to day production of a cluster of wells on the basis of an estimation of the contributions of individual wells to the continuously measured commingled production of the cluster of wells, tailored to the particular constraints and requirements of the oil and gas production environment. However, limitations of the "PU RTO" approach as applied to the control of the subsurface zones of an extended reach well include:

a. Its main reference being continuously measured commingled production of the cluster of wells under optimization, whereas for well with subsurface zones, often the key requirement is to control the zonal pressures to achieve equal zonal annulus pressures, and total flow from the well is conversely not continuously measured;

b. It assumes a common header pressure that characterizes the well interactions, whereas in extended reach wells, a different effluent flow topology and interaction pattern exists;

c. The PU RTO assumes a low level of interaction between individual wells or zones, whereas in extended reach wells, the interaction components are significant and even backflow into weak zones is possible.

d. The PU RTO assumes continuous values of the manipulated variables, whereas in the current state of the art, the multizone well zone ICD settings are restricted on a discrete set of values, and allow only limited transitions between positions, for example, only step by step incremental openings, and only closing to full close position.

It is therefore an object of the present invention to provide a method and system that supports the allocation and control of the individual zones of an extended reach well via appropriate position settings of the individual zone ICDs to optimise the day to day production of the well, addressing limitations in a, b, c, d above.

SUMMARY OF THE INVENTION

It is another object of the present invention to provide a practical sustainable method based on empirical well test data for the estimation and thereafter management of production from Smart Wells, free from the rigorous physical and flow models assumptions of publications such as SPE102743. In this specification and claims the term "zones" means "zones and or branches and or laterals or any other clearly defined part of the well in contact with a subsurface fluid reservoir and isolated from the other zones or branches and or laterals in contact with the same or different fluid reservoir."

In this specification and claims the term Inflow Control Device (ICD) shall mean an Inflow Control Valve (ICV) and/or other a means of restricting or enhancing the flow of the production fluid from a well section to the surface. Further, the collective production of well effluents of the well may be stimulated or restricted by various means, for example by adjusting the opening of a production choke valve (FCV) at the wellhead of the well, or by adjusting one or more settings of any associated artificial lift mechanisms such as surface liftgas injection rate or downhole electrical submersible valve speed or liftgas injection, or by adjusting the pressure of the well flowline. In this specification and claims, the term production choke valve or the abbreviation "FCV" shall refer to production choke valve and/or other means for stimulating or restricting the collective production of well effluents of the well.

Further, it is noted that the approach outlined herein to compute the required control valve settings is "open loop," in that it uses the underlying well and zonal production and pressure models to compute the required settings. It is not practical given the present state of the art, particularly due to item d above, to manage the control valve settings using a multivariable feedback control algorithm.

In accordance with the invention there is provided a method for controlling the influx of crude oil, natural gas and/or other effluents into inflow zones of a well comprising a plurality of distinct inflow zones through which crude oil and/or natural gas and/or other effluents are produced, which zones are each provided with an inflow control device (ICD) for controlling the fluid influx through the zone into the well, the method comprising:

a) assessing the flux of crude oil, natural gas, water and/or other effluents from the well;

b) monitoring production variables, including the position of each ICD, a fluid pressure in each inflow zone upstream of each ICD, a fluid pressure in a well tubular downstream and in the vicinity of each ICD and/or other characteristics of the effluent flowing through the well;

c) performing a well test during which production from the well is varied by sequentially adjusting the position of each of the ICD's preferably to a variety of operating commonly encountered configurations and the flux of crude oil, natural gas and/or other well effluents is assessed in accordance with step a;

d) monitoring during step c production variables in accordance with step b);

e) deriving from steps c), d) and e) a zonal production estimation model for each inflow zone of the well; and f) adjusting each ICD to control the influx of crude oil, natural gas and/or other effluents into each inflow zone on the basis of data derived from the zonal production estimation model for each inflow zone of the well;

g) repeating steps c), d), e) and f) from time to time, where step c) may be optionally repeated with a reduced level of ICD variation.

During step b), other production variables may also be monitored, such as the surface tubing head pressure, opening of the surface production choke valve (FCV) and/or the temperature of the produced well effluents.

The zonal production estimation model may provide a correlation between variations of one or more production variables and the production of the well and each of the zones during the well test in accordance with step c).

Optionally, after testing the well in accordance with step c) crude oil, natural gas and/or other effluents are produced through the well during a prolonged period whilst one or more production variables are recorded after selected intervals of time, wherein for each interval of time the estimated contribution of each zone is calculated on the basis of the zonal estimation model derived in step e).

Further, optionally, the method of PCT/EP2005/055680 may be used to reconcile the zonal estimated effluxes with surface well model estimate of accumulated well efflux, with either the zonal or the surface well model estimate of accumulated efflux taking precedence. In the event surface measurements of accumulated well efflux are available, then the method of PCT/EP2005/055680 may be used to reconcile the zonal estimated effluxes with the surface measurements of accumulated well efflux.

The method according to the invention may further comprise:

h) deriving from steps c) and d) a well and zonal production and pressure prediction model relating the ICD settings to the pressures and efflux for each inflow zone of the well, i) defining an operational optimisation target for the zones and the overall well, consisting of a target to be optimised and various constraints on the zonal and well flows or pressures or other production variables monitored in accordance with step b or otherwise estimated;

j) computing from the models of step g adjustments to settings of the production choke valve and zonal ICDs such that the optimisation target of step i is approached;

k) adjusting the settings of the production choke valve and the zonal ICD's on the basis of the computations made in accordance with step i); and l) repeating steps h), i), j) and k) are repeated from time to time.

The method according to the invention may further comprise the step of performing modelling and solution of the integrated well system and an optimisation, optionally with constraints, using any of a plurality of numerical simultaneous equation solution and optimization algorithms over the unknown and manipulated variables to yield a set of optimised manipulated variables that achieve the operational optimisation target, optionally including longer time horizon considerations such as ultimate recovery targets and production guidelines for the well, the cluster of wells and any related enhanced oil recovery mechanisms in place, the overall oil and gas field development plan and ongoing higher level optimization.

Optionally, the production of well effluents of the well and the individual zones may additionally be varied by adjusting the opening of a production choke valve (FCV) at the wellhead of the well, or by any other means of stimulating or restricting the collective production of the well including by adjusting one or more settings of any associated artificial lift mechanisms such as surface liftgas injection rate or downhole electrical submersible valve speed or liftgas injection, or by adjusting the pressure of the well flowline.

Optionally, in the absence or failure of one or more zonal measurements, the surface estimation model may be used in conjunction with the available zonal estimation models and measurements to additionally infer the pressures or zonal productions of the zones affected by the absence or failure of one or more of its measurements.

Required adjustments predicted by the method according to the invention to achieve the optimisation targets may be automatically transmitted to the wells and the zones, or alternatively, after validation by a human operator.

One or more of the estimation and/or prediction models may optionally be generated in part or in full from theoretical and/or empirical physical and/or mechanical and/or chemical characterization of the well, its zones, and the adjoining reservoir system.

The optimization target can be adjusted in reaction to and/or in anticipation of changes to the production requirements and/or costs and/or revenues and/or production infrastructure and/or state of the wells and/or the state of the associated production facilities; and optionally followed up by the conduct of the optimization process, the results of which are implemented and/or used for analysis and planning and/or recorded for future action.

One or more of the estimation and/or prediction models may optionally be compared and/or evaluated against theoretical and/or empirical physical and/or mechanical and/or chemical characterization of the wells and/or the production system; for the purposes of troubleshooting and/or diagnosis and/or for improving the models and/or for analysis leading to longer time horizon production management and optimization activities.

The method according to the invention may also be applied when one or more of the zones of the well or the overall well is periodically, or intermittently, operated, or is operated from time to time, and the production or associated quantities to be optimised, and optionally, constrained, are evaluated, for example averaged, over fixed periods of time larger than that characteristic of the periodicity or intermittent operation, and optionally, the duration of its operation, as a proportion of a fixed period of time, is taken a manipulated variable for the well.

The method according to the invention will also be referred to in this specification and claims as "Production Universe Multi-Zone Surveillance and Optimisation" (PU MZSO).

The "PU MZSO" method according to the invention has several advantages over prior art methods, similar to those, for example, outlined in the related International patent applications PCT/EP2005/055680, PCT/EP2007/053345, PCT/EP2007/053348. In particular, the "PU MZSO" method according to the invention may be used to derive various zone and well characteristics from simple zone and well testing alone, enabling direct model maintenance and dispensing with measurements and quantities not continuously measured, but nevertheless unpredictably variable over periods of time in a production environment, such as tubing surface roughness, reservoir inflow and pressure-volume-temperature fluid characteristics and composition, equipment and well performance curves, and similar, and the resulting need for period expert tuning of the resulting well configurations.

In other words, "PU MZSO" is "data driven" and the "overall zonal and well system model" of the extended reach well production system may be constructed by standard extensions to the conventional and operationally well-established practice of well testing, and without preconceptions as to its underlying physical nature other than the use basic fundamental topological and physical relations, and purely from measured data. Additionally, as noted previously, in the present state of the art, multiphase flow measurement devices have clear limitation to their deployment for subsurface zonal production surveillance in an operational environment, over the life of a well.

These and further embodiments, advantages and features of the method according to the invention are described in the accompanying claims, abstract and the following detailed description of a preferred embodiment of the method according to the invention in which reference is made to the accompanying drawings.

BRIEF DESCRIPTION OF THE DRAWINGS

The invention will be described by way of example in more detail with reference to the accompanying drawings in which.

DETAILED DESCRIPTION OF DEPICTED EMBODIMENTS OF THE INVENTION

Figure 1:
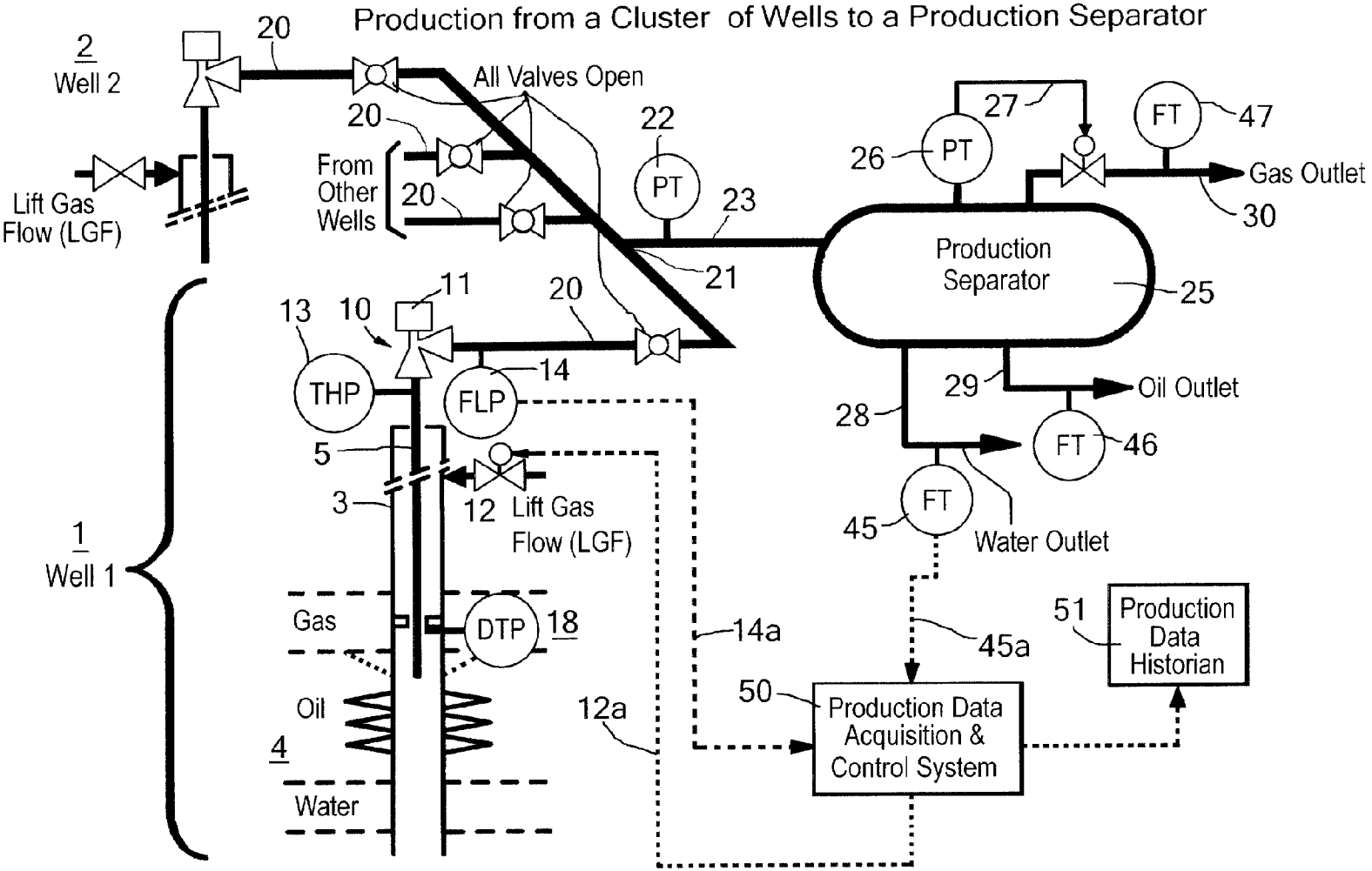
FIG. 1 schematically shows a production system according to the invention in which a multiphase fluid mixture comprising crude oil, water, natural gas and/or other fluids is produced by a cluster of multiple wells of which two are represented, and transported via multiphase fluid transport pipelines to a bulk separator.

Referring initially to FIG. 1, one embodiment of a production system comprises a cluster of wells of which effluents are commingled at a production manifold and routed to a production separator. Well 1 is shown in detail, and may be taken as representative of the other wells in the cluster. The other wells in the cluster may, however, differ in terms of nature and flux of its effluents, and/or mode of operation/stimulation/manipulation.

Well 1 comprises a well casing 3 secured in a borehole in the underground formation 4 and production tubing 5 extending from surface to the underground formation. The well 1 further includes a wellhead 10 provided with monitoring equipment for making well measurements, typically for measuring Tubing Head Pressure (THP) 13 and Flowline Pressure (FLP) 14. Optionally, there may be surface tubing and/or flowline differential pressure meters, for example wet gas meters (not shown). This patent applies to those wells that are extended reach wells with subsurface configurations that include multiple distinct producing zones, separately monitored and controlled, see FIG. 3. The wellheads of the wells in a cluster may be located on land or offshore, above the surface of the sea or on the seabed.

Well 1 will also have some means of adjusting production, such as a production choke valve 11 and/or a lift-gas injection control system 12 or downhole interval control valves (see FIG. 3), which control the production from one or more inflow regions of the well.

The surface production system further includes a plurality of well production flow lines 20, extending from the wellheads 10 to a production manifold 21, a production pipeline 23 and a means of separating the commingled multiphase flow, in this case, a production separator 25. Production manifold pressure measurement 22 and production separator pressure measurement 26 will often be available on the production manifold and the production separator as shown. There will be some means of regulating the level of the production separator, and optionally its pressure or the pressure difference between the separator its the single-phase outlets. For simplicity a pressure control loop 27 is show in FIG. 1.

Figure 2:
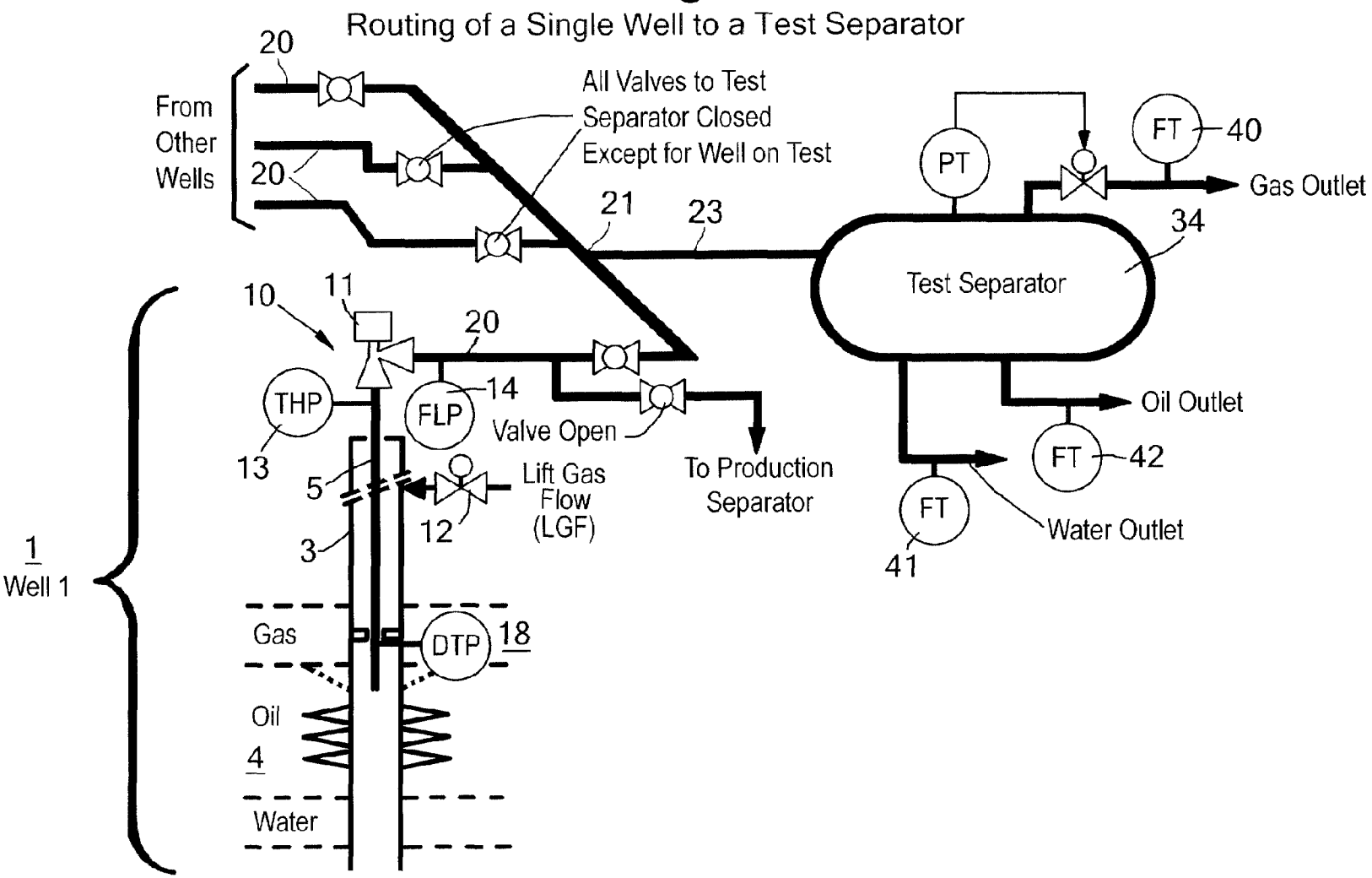
FIG. 2 schematically shows a well being routed to a well testing apparatus, in this case, a Well Test Separator, as part of a Well Testing Process.

Production separator 25 is provided with outlets for water, oil and gas 28, 29 and 30 respectively. Each outlet is provided with flow metering devices, 45, 46 and 47 respectively. Optionally, the water and oil outlets can be combined. The wells in FIG. 1 may each be routed individually to a shared well testing apparatus, as depicted in FIG. 2, as part of a Well Testing Process. FIG. 2 shows a Well Test Separator 34, optionally a multiphase flow meter. The Well Test Separator, optionally multiphase flow meter, will have means of separately measuring the oil flow 42, water flow 41 and gas flow 40 from the well under test.

Figure 3:
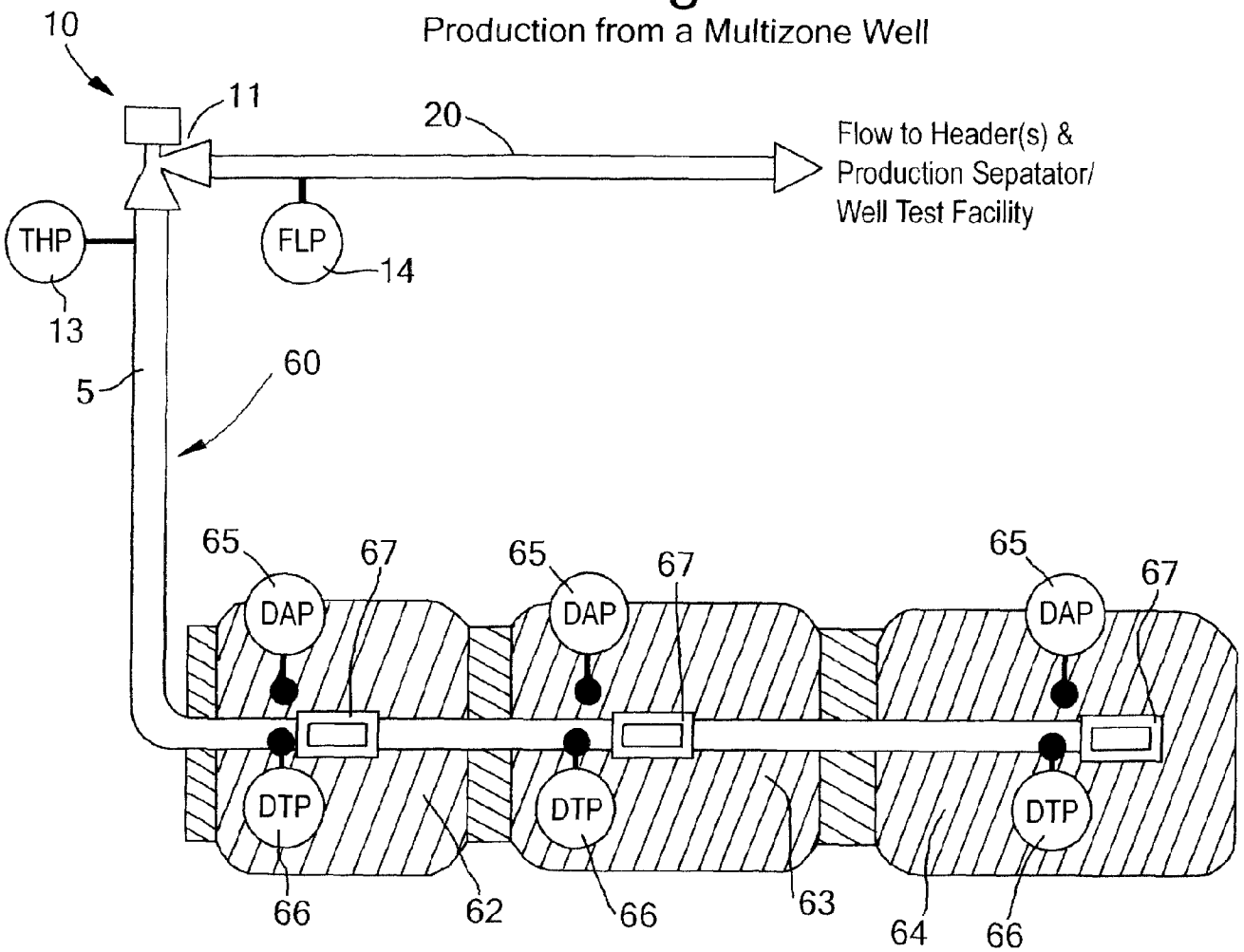
FIG. 3 illustrates a multi-zone well with segments that form different inflow regions.
Figure 3A:
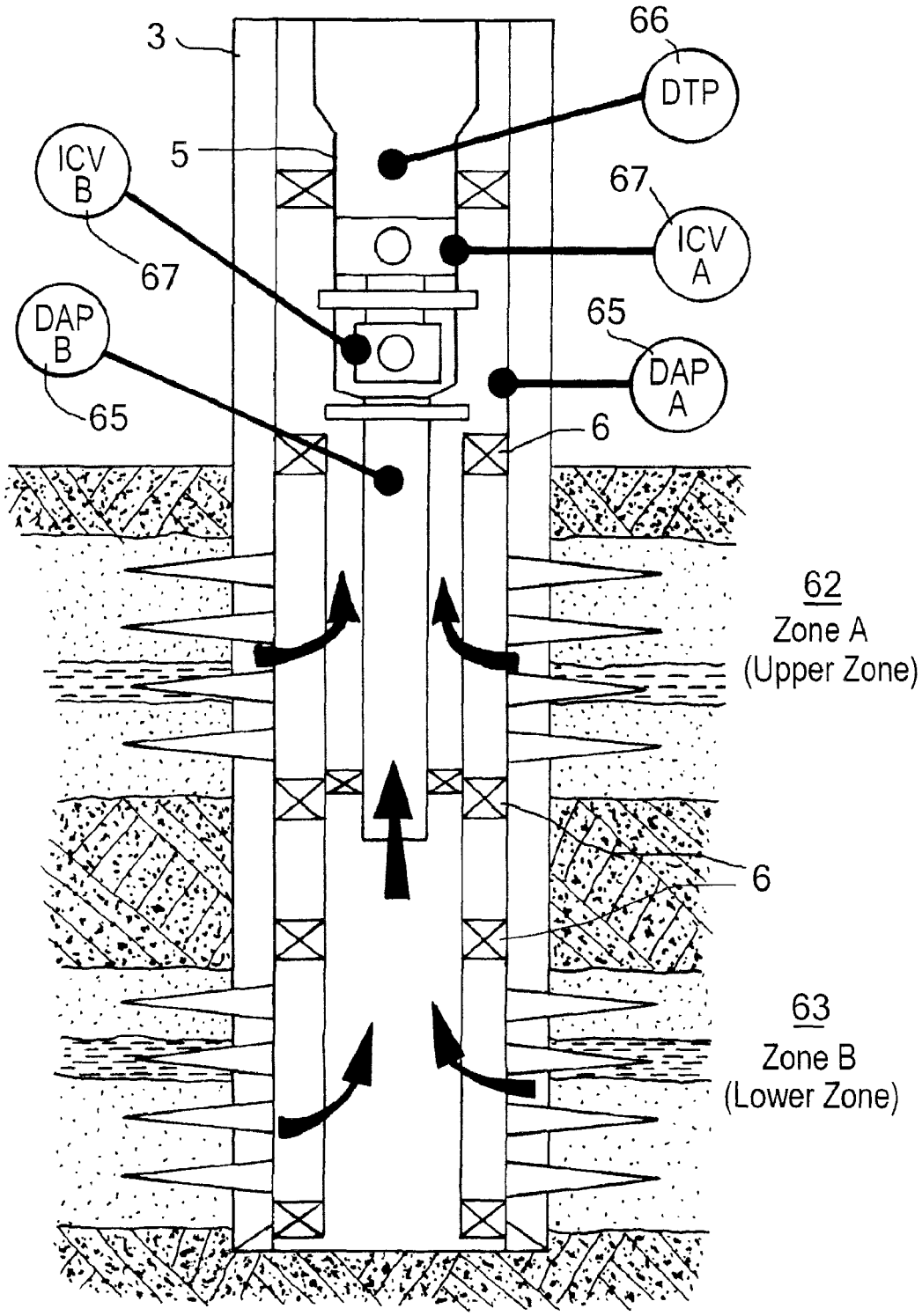
FIG. 3*a* additionally illustrates an optional configuration in which the upper and lower injection zones branch via concentric tubing from a single point.

A typical multizone well subsurface configuration is as shown FIG. 3, which illustrates a multizone well 60 with tubing 5 extending to well segments, which form three distinct producing zones 62, 63, 64. Each zone has means of measuring the variations of thermodynamic quantities of the fluids within zone as the fluid production from the zone varies, and these can include downhole tubing pressure gauges 66 and downhole annulus pressure gauges 65. Each zone may also have a means for remotely adjusting, from the surface, the production through the zone, for example, an interval control valve 67, either on-off or step-by-step variable or continuously variable. The multizone well 60 further includes a wellhead 10 provided with well measurements, for example, "Tubing Head Pressure" 13 and "Flowline Pressure" 14, with the most downstream downhole tubing pressure gauge corresponding to item 18 in FIG. 1. The well 60 produces into a multiphase well effluent flowline 20, extending from the well to a production header (already depicted on FIG. 1). FIG. 3*a* illustrates another optional extended reach well configuration variant with a two zone well (Zones A 62, and Zone B, 63, separated by packers 6). The tubing 5 branches into two separate concentric flow paths from Zone A and Zone B, controlled via interval control valves ICD A and ICD B, 67. The is a shared downhole tubing pressure gauge 66 and separate downhole annulus pressure gauges 65 for each zone.

The well measurements comprising at least data from 13, 65 and 66 and optionally from 14, liftgas injection rate from 12, position of production choke 11, and other measurements, as available, are continuously transmitted to the "Production Data Acquisition and Control System" 50. Similarly, the commingled surface production and well test measurements 40, 41, 42, 45, 46, 47 are continuously transmitted to the "Production Data Acquisition and Control System" 50. The typical data transmission paths are illustrated as 14*a* and 45*a*. The data received in 50 is stored in a Process Data Historian 51 and is then subsequently available for non-real time data retrieval for data analysis, model construction and production management. The data in 51 is also accessed by "PU MZSO"

in real time for use in conjunction with surface and zone production estimation models for the continuous real time estimation of individual zone and well productions. Some well production rate controls will also be adjustable from 50 for remotely adjusting and optimising the well and zone production, and the signal line for lift-gas injection rate control is shown as 12*a*.

Figure 4:
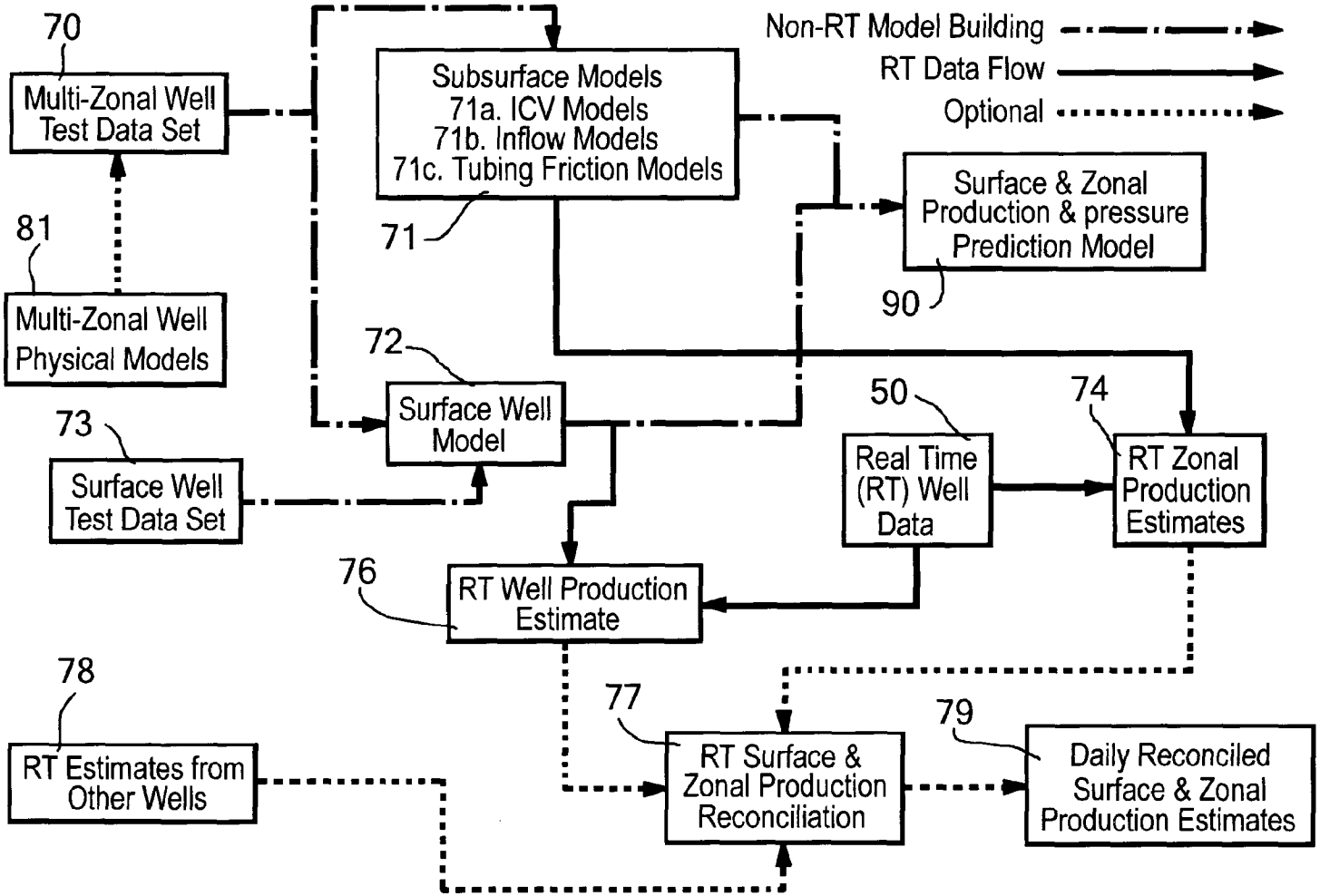
FIG. 4 schematically shows how data from well testing is used to construct the PU MZSO models and how real time estimates are generated.

Reference is now made to FIG. 4, which depicts an embodiment of the method for this invention, the intent of which is to generate sustainably useful models fit for the intent of the invention, taking into account only significantly relevant well and production system characteristics and effects.

The procedure leading to the generation of real time estimates of zonal production, and "Surface and Zone Production and Prediction Models" for a well with n zones indexed i=1, 2, . . . , n, is described as follows:

A well test is conducted during which the multizone well is routed to the well test apparatus 34 and production from each zone is varied by changing the ICD of the zones as well as the surface production choke 11. The zonal well test data 70 accumulated in the Production Data Historian 51 is used to generate "subsurface models" 71 as well as "surface production estimation model" 72. Optionally, surface well testing 73 in which the well is tested at a fixed rate, or only the production choke valve is varied, in a "DDWT" as described in previous PU RTM international patent application PCT/EP2005/055680, can be conducted. The "surface production estimation model" of a well is of the form $Y=f_S(u_S, v_S, v, t)$, valid for a range of $u_S$, $v_S$, v within a set of real numbers $U_S \times V_S \times V \times T$, wherein the vector Y is the oil, water and gas production of well, or optionally the combined multiphase effluent mass production rate of the well, $u_S$ is the vector of measurements at well, $v_S$ is the surface manipulated variable, v is optional and is the vector of subsurface manipulated variables, and t is time. In a preferred embodiment, $u_S$ can be the tubing head pressure 13 and the downhole tubing pressure 18 or alternatively, the tubing head pressure 13 and the flowline pressure 14. Similarly, $v_S$ can be the liftgas flowrate or the production choke valve opening. The subsurface ICD information v is required particularly in cases where the GOR or watercut of the zones are significantly differentiated. The function $f_S$ is constructed using the well test data from zonal well test data 70 and optionally, surface well testing 73, using dedicated well test facilities is as previously outlined in "PU RTM." From multiple tests at different times, a time variation may be inserted into the model to account for any observed changes, in for example, watercut, over time. It may be noted that in the case $u_S$ is the tubing head pressure 13 and the downhole tubing pressure 18, then the function $f_S$ is related to the vertical lift performance of the well. Further, if Y represents the combined multiphase effluent mass production rate of the well, then Y can be related to the measurements of oil, water and gas from the test apparatus by the indicative densities of the individual phases.

The "Subsurface Models" 71 are preferably of three parts "Zonal ICD Models" 71*a*, (ii) the "Zonal Inflow Model" 71*b*, and (iii) "Tubing Friction Models" 71*c*. The "Zonal ICD Models" will be of the form $y_i=k_i(u_i, v_i, t)$, valid for a range of $u_i$, $v_i$, t within a set $U_i \times V_i \times T$, wherein the vector $y_i$ is the oil, water and gas production of zone i, $u_i$, is the vector of measurements at zone i, most commonly the annulus and tubing pressure gauges 65 and 66 in FIG. 3, and $v_i$ is the manipulated variable at zone i, the ICD opening. The "Zonal ICD Models" in effect characterize the flow through the ICDs at various ICD openings and zonal tubing and annulus pressures.

The "Zonal Inflow Model" will be of the form $y_i=l_i(u_i, p_{Ri}, t)$, valid for a range of $u_i$, $p_{Ri}$, t within a set $U_i \times P_{Ri} \times T$, wherein the vector $y_i$ is the oil, water and gas production of zone i, or optionally a scalar representing the combined multiphase effluent mass production rate of the zone, $u_i$ is the vector of measurements at zone i, in particular the annulus pressure gauges 65 in FIG. 3, and $p_{Ri}$ is the underlying reservoir pressure for zone i, which is obtained from the downhole annulus pressure 65 when the zone is closed in over a period of time. The zonal inflow $l_i$ characteristic and reservoir pressure $p_{Ri}$ can be expected to decline with time t. Finally, the "Tubing Friction Models" will be of the form $y_{ij}=m_{ij}(u_{ij})$, valid for a range of $u_{ij}$ within a set $U_{ij}$, wherein the vector $y_{ij}$ is the oil, water and gas flow between from zone i to zone j, or optionally a scalar representing the combined multiphase effluent mass flow rate between from zone i to zone j, $u_{ij}$ is the vector of measurements at zone i and zone j, in particular the downhole tubing pressure gauges 66 in FIG. 3. The "Tubing Friction Models" 71 are required due to the daisy chain configuration of the extended reach wells. In the above, if the mass flow rates are used, then the mass flow rates are related to the measurements of oil, water and gas from the test apparatus by the indicative densities of the individual phases.

Given the multi-zonal Well test data 70, the procedures for constructing "Zonal ICD Models", the "Zonal Inflow Models" and the "Tubing Friction Models" is as previously outlined in "PU RTM" and "PU DDPT".

During normal production mode as depicted in FIG. 1, when the well is producing into the production separator 25 together with other wells in the cluster, given the "Zonal ICD Models" 71*a*, and real time subsurface data from the Data Acquisition and Control System 50, real time estimates of the zonal production flows may be computed 74. The "Zonal Inflow Models" 71*b* may also be used to estimate 74. Similarly, given the surface well model 72, the real time surface production rate may be estimated 76.

As the total of the zonal productions should equal the surface production, the zonal production estimates may be reconciled with the surface production estimate over a period of time, using the "PU RTM" methods outlined in international patent application PCT/EP2005/055680, to give item 77 in FIG. 4. Either the zonal productions or the surface production may be given precedence. Similarly, the production estimate from the multizone extended reach well can be combined with estimated productions from the other wells in the cluster, and reconciled with the commingled single phase production measurements 45, 46, 47 in FIG. 1, to give item 79 in FIG. 4.

Given surface and subsurface models, $$Y=f_S(u_S,v_S,t), y_i=k_i(u_i,v_i,t), y_i=l_i(u_i,p_{Ri},t), y_{ij}=m_{ij}(u_{ij}), \quad i=1,2,\ldots,n$$

and boundary conditions of zonal reservoir pressures $P_{Ri}$, time t, and flowline pressure 14, and the relation $$Y=\sum_{i=1}^{n} y_i,$$

it should be clear to an expert in the field that the problem is a network or nodal analysis problem and is solvable for Y, $y_i$, i=1, 2, . . . , n for given combinations of $v_S$, $v_i$, i=1, 2, . . . , n, assuming sufficiently well-behaved functions $f_S(.)$, $k_i(.)$, $l_i(.)$, $m_{ij}$. Hence the relations above collectively constitute the "Surface and Zonal Production and Pressure Prediction Model" 90, of FIG. 4. Preferably, as the positions of the valves and the surface and downhole pressures, $v_S$, $v_i$, i=1, 2, . . . , n, $u_S$, $u_i$, i=1, 2, . . . , n are known in real time, the difference form of the relations of 90 may be used:

$$\Delta Y = \hat{f}_{s,u_s,v_s}(\Delta u_s, \Delta v_s),$$

$$\Delta Y = \sum_{i=1}^{n} \Delta y_i,$$

$$\Delta y_i = \hat{k}_{i,u_i,v_i}(\Delta u_i, \Delta v_i),$$

$$\Delta y_i = \hat{l}_{i,u_i}(\Delta u_i),$$

$\Delta y_{ij} = \hat{m}_{ij,u_{ij}}(\Delta u_{ij})$, i=1, 2, . . . , n, where ΔY denotes differential changes to Y, and $\hat{f}_{S,u_S,v_S}$ denotes the first order approximation of $f_S$ with respect to the differenced variables at the values of $u_S$, $v_S$ measured at the time, or averaged over a time period immediately preceding the instance of the initialization of computation, and similarly for the functions $\hat{k}_{i,u_i,v_i}(.)$, $\hat{l}_{i,u_i}(.)$, and $\hat{m}_{ij,u_{ij}}(.)$. The differenced form allows consideration of changes only as a result of changes in the manipulated variables, and the results of the computation to be consistent with the current state of the multizone well as measured in real time in terms of the current valve positions and measured downhole and surface pressures, $v_S$, $v_i$, i=1, 2, . . . , n $u_S$, $u_i$, i=1, 2, . . . , n.

Figure 5:
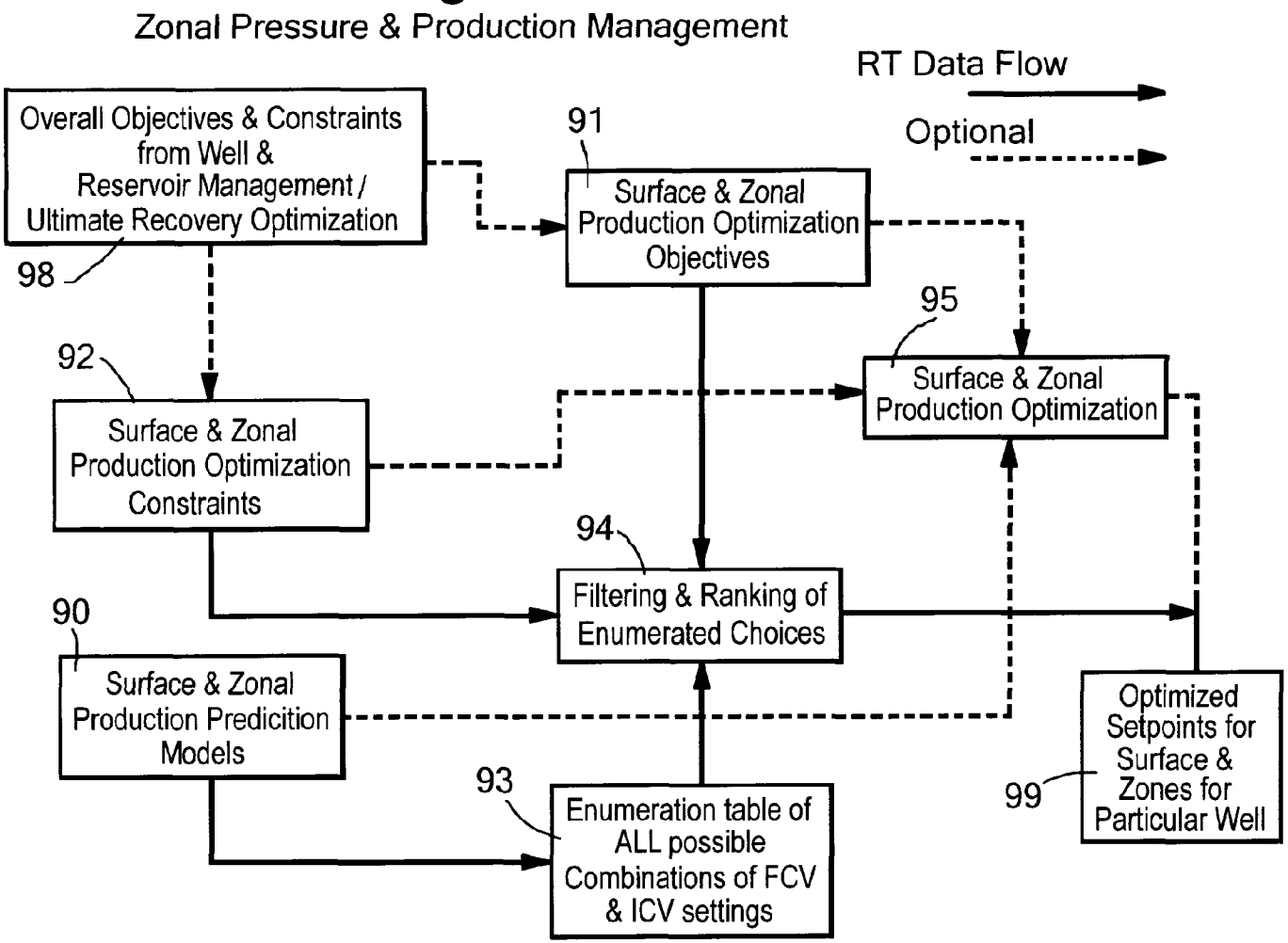
FIG. 5 schematically depicts key steps in the use of the data to generate setpoints for the control of the zonal production and pressures.

Once the "Surface and Zonal Production and Pressure Prediction Model" 90 is available, the control of the well production and pressures is implemented as per the workflow in FIG. 5. If the required FCV and ICD control setpoints $v_S$, $v_i$, i=1, 2, . . . , n were continuously variable, then, based on the desired zonal and surface production and pressure levels, the optimal or most suitable set of FCV and ICD settings $v_S$, $v_i$, i=1, 2, . . . , n can be computed using an optimization framework 95 as follows:

$$\max_{v_s, v_i} R(Y, u_s, v_s, u_i, v_i, i = 1, 2, \ldots, n)$$

subject to constraints $c_j(Y, u_S, v_S, u_i, v_i, i=1, 2, \ldots, n) \geqq 0$, j=1, 2, . . . , J.

where R is the objective or revenue function 91 for the multizonal well to be maximized by varying $v_S$, $v_i$, i=1, 2, . . . , n, the manipulated variables at well and its zones, subject to J constraints on Y, $u_S$, $v_S$, $u_i$, $v_i$, i=1, 2, . . . , n, the well and zone production, the well and zone manipulated variables and the well and zone measured variables, respectively, 92.

However, as noted previously, it is currently the state of the art that the subsurface ICD positions, $v_i$, i=1, 2, . . . , n, can only vary a limited number of positions, say, N. The surface production control may also by restricted to the same number of positions. Hence, since the number of zones per extended reach well is limited to date to n≧4, there are only $N^{n+1}$ possible combinations for $v_S$, $v_i$, i=1, 2, . . . , n, and it is the preferred approach to enumerate the entire range of possibilities to produce an Enumeration Table 92. Given the enumeration based on the $N^{n+1}$ possible combinations for $v_S$, $v_i$, i=1, 2, . . . , n, and the surface and zonal prediction model 90, it is straight forward to filter the table 93 as per the constraints 92 and rank the remaining alternatives using the objective function 91 to obtain a list of filtered and ranked setpoint choices. The best set of setpoints for $v_S$, $v_i$, i=1, 2, . . . , n may therefore be selected 99.

The set of "optimised setpoints" is then available for further action. Reference may be made to the Applicant's International Patent application PCT/EP2007/053348, for a variety of possible actions to suit operational requirements following the computation of the setpoints.

What is claimed is:

1. A method for controlling influx of crude oil, natural gas and/or other effluents into inflow zones of a well comprising a plurality of distinct inflow zones through which crude oil and/or natural gas and/or other effluents are produced, which zones are each provided with an inflow control device (ICD) for controlling the fluid influx through the zone into the well, the method comprising:

a) assessing the flux of crude oil, natural gas, water and/or other effluents from the well;

b) monitoring production variables, including the position of each ICD and/or the fluid pressure in each inflow zone upstream of each ICD and/or the fluid pressure in a well tubular downstream and in the vicinity of each ICD and optionally further including the fluid pressure and/or other characteristics of the effluent flowing through the well or surface tubulars connected to a wellhead of the well and/or the position of one or more valves arranged in the well and/or at or near the wellhead, such as the position of a the production choke valve (FCV) at or near the wellhead;

characterized in that the method further comprises:

c) performing a well test during which production from the well is varied by sequentially adjusting the position of each of the ICDs and the flux of crude oil, natural gas and/or other well effluents is assessed in accordance with step a;

d) monitoring during step c production variables in accordance with step b;

e) deriving from steps c and d a zonal production estimation model for each inflow zone of the well; and f) adjusting each ICD to control the influx of crude oil, natural gas and/or other effluents into each inflow zone on the basis of data derived from the zonal production estimation model for each inflow zone of the well;

g) repeating steps c), d), e) and f);

h) deriving from steps c) and d) a well and zonal production and pressure prediction model relating the ICD settings to the pressures and efflux for each inflow zone of the well;

i) defining an operational optimisation target for the zones and the overall well, consisting of a target to be optimised and various constraints on the zonal and well flows or pressures or other production variables monitored in accordance with step b or otherwise estimated;

j) computing from the models of step h) adjustments to settings of the production choke valve (FCV) and zonal ICDs such that the optimisation target of step i) is approached;

k) adjusting the settings of the production choke valve and the zonal ICDs on the basis of the computations made in accordance with step j); and l) repeating steps h), i), j) and k) from time to time.

2. The method of claim 1 wherein step c is repeated with a reduced level of ICD variation.

3. The method of claim 1 wherein the zonal production estimation model provides a correlation between variations of one or more production variables and the production of the well and each of the zones during the well test in accordance with step c.

4. The method of claim 3, further comprising:

measuring accumulated well efflux at the earth surface; and reconciling the zonal estimated effluxes with surface measurement of accumulated well efflux.

5. The method of claim 1 wherein after testing the well in accordance with step c crude oil, natural gas and/or other effluents are produced through the well during a prolonged period whilst several production variables are recorded after selected intervals of time, wherein for each interval of time the estimated contribution of each zone is calculated on the basis of the zonal estimation model derived in step e.

6. The method of claim 5, further comprising:

reconciling the zonal estimated effluxes with a surface well model estimate of accumulated well efflux, with either the zonal or the surface well model estimate of accumulated efflux taking precedence.

7. The method of claim 1, further comprising the step of performing modelling and solution of the integrated well system and an optimisation, optionally with constraints, using any of a plurality of numerical simultaneous equation solution and optimization algorithms over the unknown and manipulated variables to yield a set of optimised manipulated variable settings (ICD settings) that achieve the operational optimisation target, optionally including longer time horizon considerations such as ultimate recovery targets and production guidelines for the well, the cluster of wells and any related enhanced oil recovery mechanisms in place, the overall oil and gas field development plan and ongoing higher level optimization.

8. The method of claim 1 wherein the production of well effluents of the well and the individual inflow zones is additionally varied by adjusting the opening of a production choke valve (FCV) at the wellhead of the well, or by any other means of stimulating or restricting the production of the wells including by adjusting one or more settings of any associated artificial lift mechanisms such as surface liftgas injection rate or downhole electrical submersible valve speed or liftgas injection, or by adjusting the pressure within a flowline connected to the wellhead.

9. The method of claim 1 wherein in the temporary absence or failure of one or more zonal measurements, the surface estimation model is used in conjunction with the available zonal estimation models and measurements to additionally infer the pressures or zonal productions of the zones affected by the temporary absence or failure of one or more of its measurements.

10. The method of claim 1, further including at least one of the following steps:

automatically transmitting adjustments predicted by the method according to the invention to achieve the optimisation targets to the wells and the zones;

generating one or more of the estimation and/or prediction models in part or in full from theoretical and/or empirical physical and/or mechanical and/or chemical characterization of the well, its zones, and the adjoining reservoir system; and adjusting the optimization target in reaction to and/or in anticipation of changes to the production requirements and/or costs and/or revenues and/or production infrastructure and/or state of the wells and/or the state of the associated production facilities; and optionally conducting the optimization process, the results of which are implemented and/or used for analysis and planning and/or recorded for future action.

11. The method of claim 1 wherein one or more of the estimation and/or prediction models are compared and/or evaluated against theoretical and/or empirical physical and/or mechanical and/or chemical characterization of the wells and/or the production system.

12. The method of claim 11 wherein said comparison is made for the purposes of troubleshooting and/or diagnosis and/or for improving the models and/or for analysis leading to longer time horizon production management and optimization activities.

13. The method of claim 1 wherein one or more of the zones of the well or the overall well is periodically, or intermittently, operated, or is operated from time to time, and the production or associated quantities to be optimised, and optionally, constrained, are evaluated, for example averaged, over fixed periods of time larger than that characteristic of the periodicity or intermittent operation, and optionally, the duration of its operation, as a proportion of a fixed period of time, is taken as a manipulated production variable for the well.

14. The method of claim 1 wherein the ICDs are Inflow Control Valves (ICVs) and during step c) a series of dynamically disturbed well tests are performed during which sequentially one ICV is closed and the other ICVs are gradually opened in a sequence of steps and the flux of crude oil, natural gas and/or other well effluents is assessed in accordance with step a).

* * * * *